US005692447A

United States Patent [19]

Papajewski et al.

[11] Patent Number: 5,692,447

[45] Date of Patent: Dec. 2, 1997

[54] KNIFE MECHANISM DRIVE FOR A BUTTONHOLE SEWING MACHINE

[75] Inventors: Rudy Papajewski; Gerd Papajewski, both of Stutensee, Germany

[73] Assignee: AMF Reece, Inc., Mechanicsville, Va.

[21] Appl. No.: 710,955

[22] Filed: Sep. 24, 1996

[51] Int. Cl.[6] ..... D05B 37/06; D05B 3/06

[52] U.S. Cl. ..... 112/68; 112/264.1

[58] Field of Search ..... 112/68, 129, 130, 112/264.1, 65, 66

[56] References Cited

U.S. PATENT DOCUMENTS

| | | | |
|---|---|---|---|
| 498,216 | 5/1893 | Reece . | |
| 581,031 | 5/1897 | Ostrom . | |
| 649,870 | 5/1900 | Hogan . | |
| 655,637 | 8/1900 | Reece . | |
| 856,014 | 6/1907 | Allen et al. . | |
| 1,473,240 | 11/1923 | McCann . | |
| 1,669,912 | 5/1928 | Reece . | |
| 1,738,868 | 12/1929 | Carlson . | |
| 1,771,670 | 7/1930 | Carlson . | |
| 2,063,398 | 12/1936 | Pikul et al. . | |
| 2,174,294 | 9/1939 | Spaine . | |
| 2,273,242 | 2/1942 | Wood . | |
| 2,367,187 | 1/1945 | Collins . | |
| 4,181,083 | 1/1980 | Bajer et al. | 112/68 X |
| 5,067,422 | 11/1991 | Sakuma | 112/68 |
| 5,085,157 | 2/1992 | Jung et al. . | |

*Primary Examiner*—Peter Nerbun
*Attorney, Agent, or Firm*—James Creighton Wray

[57] ABSTRACT

A grooved barrel cam is mounted on a needle bar drive shaft. As the last step, after stitching is completed and power is removed, an engaging arm inserts a follower pin into the cam. A knife cam follower lever drives a knife drive shaft and a knife driving lever. The knife driving lever drives a knife holder downward. A connector at a middle of the knife holder maintains the holder vertical. A knife is secured at the bottom of the knife holder. The cam and a tension spring angularly return the cam follower lever, the shaft and the knife lever and lift the holder, when the cut has been completed. A compression spring around the knife drive shaft moves the follower away from the cam once the engaging arm has released the follower. Engaging the knife cam follower and operating the knife driving mechanism on the last revolution after the clutch is released helps exhaust the kinetic energy of the sewing machine before bringing the machine to a stop.

14 Claims, 4 Drawing Sheets

KNIFE MECHANISM DRIVE FOR A BUTTONHOLE SEWING MACHINE

BACKGROUND OF THE INVENTION

The present invention relates to a knife mechanism in sewing machines for producing buttonholes in a workpiece. Existing sewing machines generally use a knife and a cutting plate to perform the cutting. Either the knife or the cutting plate is fixed, while the linear motion of the other allows the knife to cut the workpiece and form a buttonhole. Needs exist for improved knife construction, mechanisms and operations for creating dependable, repeatable and high-speed cuts for buttonholes.

SUMMARY OF THE INVENTION

An objective of the present invention is to remedy the disadvantages of the prior art by providing a reliable apparatus that allows users to form buttonholes in garments.

The knife mechanism uses a barrel cam to engage the knife. That eliminates previous problems of insufficient force to complete the cutting cycle. Earlier designs used a spring to withdraw the knife. The barrel cam provides a positive means of inserting and withdrawing the knife from the workpiece. Adjustments aligning the knife to the throat plate are also much easier to make, using only one screw for sideways adjustment.

In a very last step of forming a buttonhole, after stitching is completed and power is removed, a knife holder engaging arm pushes a cam follower lever and inserts a follower pin in a grooved barrel cam mounted on a needle bar drive shaft. A knife driving lever is then driven downward and upward by the cam follower lever. The lever is fixed to the knife drive shaft which extends from an inside to an outside of a buttonhole sewing machine. A knife drive lever on the outer end of the shaft drives a knife holder downward and then upward. The knife holder has a central idler link which keeps the holder vertical. In one form, the knife holder has curved slots which move on rollers on fixed axes. A knife is secured by a single screw at a bottom of the knife holder. A compression spring positioned around the knife drive shaft moves the cam follower and pin out of contact with the cam when a cut has been completed. A tension spring moves the follower away from the cam and holds the assembly in the knife-up position. Engaging the knife driving lever on the last revolution after the clutch is released helps exhaust some of the kinetic energy before forcefully bringing the machine to a stop.

In a preferred embodiment, a driver drives a needle bar drive shaft about an upper axis of the machine. A grooved barrel cam is mounted on the needle bar drive shaft and rotates about the axis of the needle bar drive shaft. The barrel cam has a groove on a radial surface that follows a circumference of the cam and snakes axially back and forth.

A main coordinating camp cam drives a lever that changes the position of an engaging arm. The arm pushes against the knife cam follower lever. The cam follower lever has a pin end and a shaft end. The pin end has a knife cam follower pin that is received by the groove of the knife cam. The engaging arm pushes against the shaft end of the knife cam follower lever. The cam follower lever carries the follower pin into the groove of the knife cam.

A first end of a knife drive shaft is connected to the knife cam follower lever at the shaft end. The knife cam follower and shaft pivot about a central axis of the knife shaft. A machine housing has an inside and an outside. A knife shaft hole passes from the inside to the outside. The knife shaft hole receives the knife shaft, and bearings allow the shaft to pivot about and translate along a central axis of the knife drive shaft.

The knife drive lever is fixed on a second end of the shaft. The lever pivots about the central axis of the shaft. A knife holder has a drive opening which slideably receives a drive pin or roller connected to the distal end of the knife drive lever. The shaft, knife drive lever and drive pin form a pre-assembly knife lever assembly. When the lever pivots, the knife pierces a workpiece between lateral bight stitches and creates an opening in the workpiece to form a buttonhole. The knife is lifted out of the workpiece by the knife holder, the lever, the shaft, the follower and the cam.

In a preferred embodiment, the follower pin is a cam follower stud pin having a cam follower end and a mounting end. The cam follower lever has a block on the shaft end of the cam follower lever. The engaging lever arm pushes the block to move the cam follower toward the cam. The pin end of the cam follower lever has a stud aperture to receive and secure the cam follower stud pin. The pin may rotate in the aperture; a collar is clamped to the opposite end of the stud pin. The shaft end of the cam follower has a slotted shaft aperture to receive the first end of the shaft and a clamping hole transverse to the shaft aperture to receive a set screw for securing the shaft in the shaft aperture.

In a preferred embodiment, the engaging lever arm pivots on a vertical lever pivot shaft. The lever arm has a first engaging end and a second mounting end with a split central hole which clamps the engaging lever pivot shaft. A finger at the first end pushes the knife cam follower lever.

The preferred embodiment has a cam follower lever disengagement spring with first and second ends. The first end abuts the back of the knife shaft hole in the machine housing. The second end abuts the shaft end of the knife cam follower. The knife shaft passes through the disengagement spring. When the engagement lever arm is no longer pressing against the knife cam follower lever, the spring returns the knife cam follower lever to a disengaged position. In that position, the follower pin does not engage the groove of the knife cam.

These and further and other objects and features of the invention are apparent in the disclosure, which includes the above and ongoing written specification, with the claims and drawings.

DETAILED DESCRIPTION OF THE DRAWINGS

Figure 1:
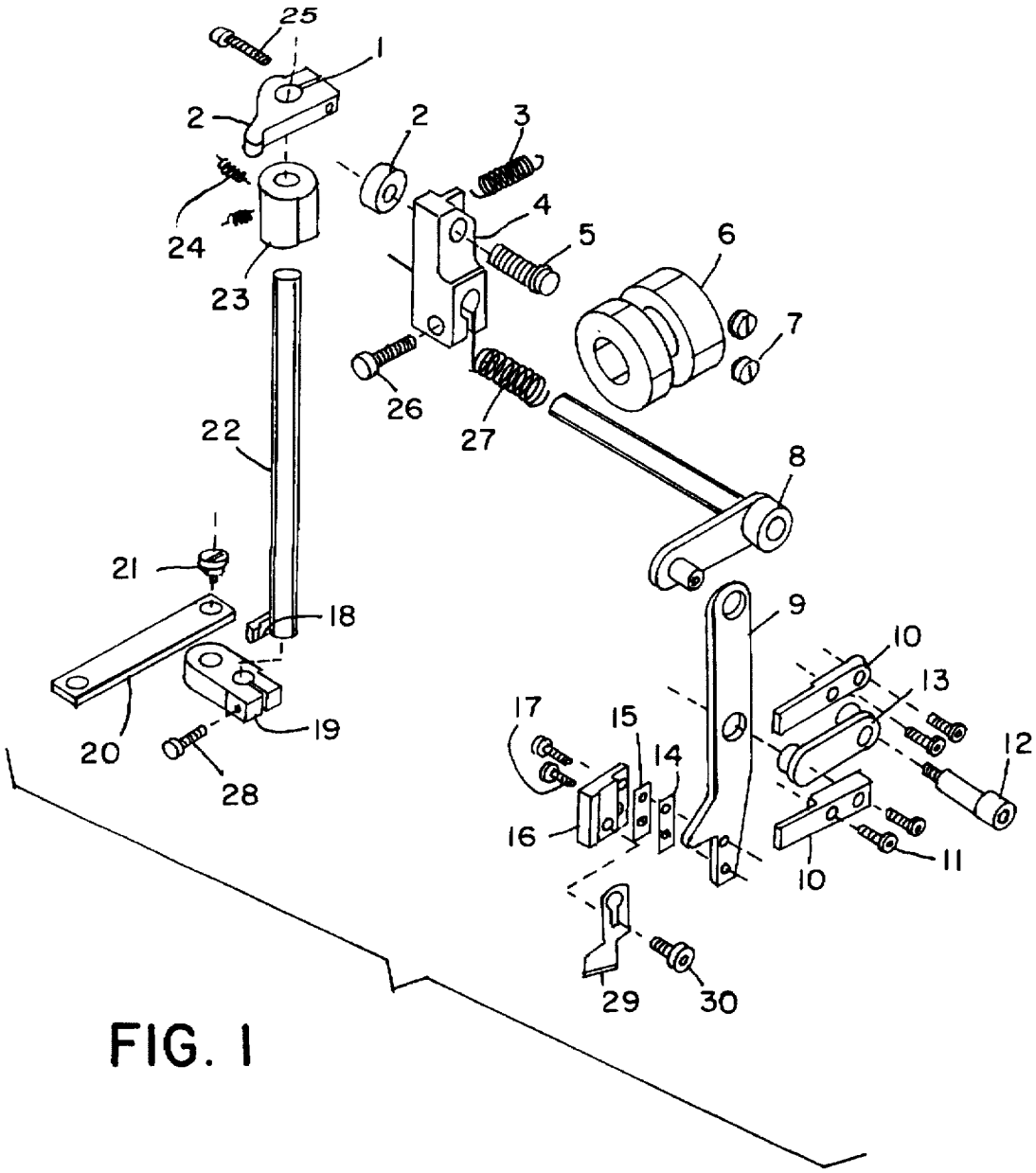
FIG. 1 shows an exploded view of a preferred knife drive mechanism.

Referring to FIG. 1, an engaging lever 1 having engaging cam or arm 2 presses a cam follower lever 4 toward a knife cam 6. Screws 7 secure the cam 6 to an upper, needle bar drive shaft. A knife cam follower stud pin 5 is mounted in the follower lever 4 with a collar 2. A return spring 3 draws the knife drive mechanism to its initial position.

A knife lever assembly 8 includes a knife drive shaft, with a keyed press fit connection to a lever and boss, and a roller at a distal end of the lever.

A knife holder 9 has upper and medial holes for receiving the rollers on the knife lever assembly 8 and the knife guide link 13. Link 13 mounts on a screw pin 12 which is connected to the machine housing. Knife cover cross bars 10, mounted on the housing with set screws 11, keep the knife holder inward, while allowing rocking movement on the lever and link.

Knife shims 14 and 15 are positioned between knife holder shim block 16 and holder 9. The shims, block and holder are connected with screws 17. Knife 29 is mounted on the shim block 16 with a cap screw 30.

A main cam follower drives a knife bearing link 20, which is connected by a screw 21 to a knife bearing clamp 19. Key 18 and cap screw 28 connect the clamp 19 to knife engagement shaft 22. A cam barring tension release connector 23 is connected to the engaging lever 1 and to the shaft 22 with screws 24.

Figure 2:
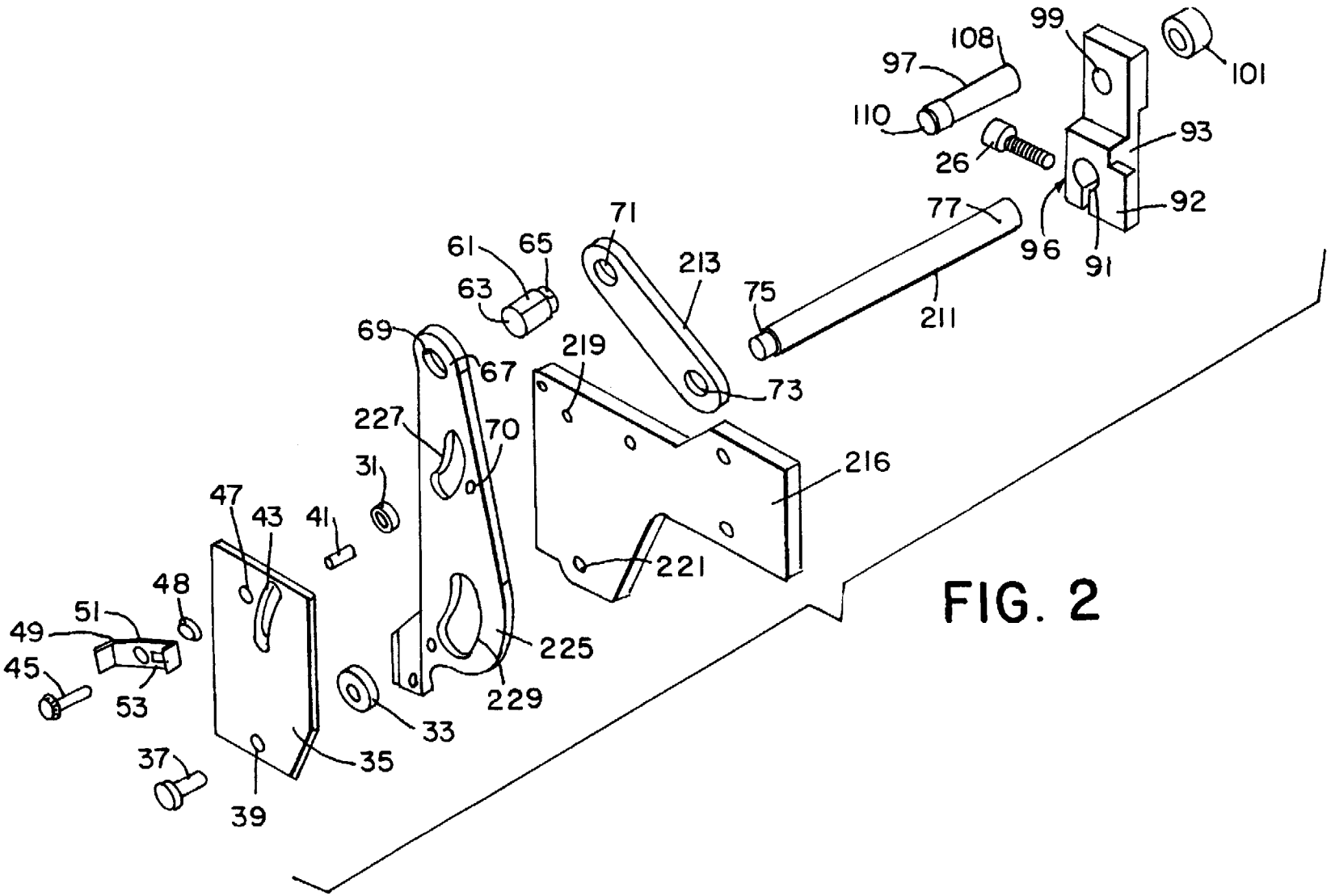
FIG. 2 is an exploded view of an alternate drive mechanism.

Referring to FIG. 2, an upper pin 45 and a lower pin 37 secure a cover plate 35 over a knife holder 225 and a holder bracket 216. The upper pin 45 is inserted through a collar 48 mounted in the central hole 51 in a pin lever 49. The upper pin 45 extends through an aperture 47 in the cover plate 35, through an upper knife roller 31 positioned in an upper elongated opening 227 in the knife holder 225, and into an upper hole 219 in the holder bracket 216. The lower pin 37 extends through a first aperture 39 in the cover plate 35, through a lower knife roller 33 positioned in a lower elongated opening 229, and into a lower hole 221 in the holder bracket 216. A third pin 41 extends through an upper small opening 70 in the knife holder 225, through an elongated opening 43 in the cover plate 35, and through a distal opening 53 in the pin lever 49.

A knife stud pin 61 has a first recessed end 65 and a second end 63. The enlarged end 63 of the knife stud pin 61 is mounted in a first opening 67 in an upper end 69 of the knife holder 225. The smaller end 65 of the knife stud pin 61 is press fit in a first distal aperture 71 of the knife lever 213. A first end 75 of a knife shaft 211 is fixed in the second aperture 73 of the knife lever 213.

Knife cam follower lever 93 has a lever arm block 92 which protrudes from the shaft end of the knife cam follower lever 93. An end 77 of the knife drive shaft 211 is mounted in a slotted aperture 91 in the knife cam follower lever 93. A clamping screw 26 is inserted in a clamping hole 96 in the knife cam follower lever 93 below the shaft aperture 91 perpendicular to the knife shaft 211 to secure the knife shaft 211 in the knife cam follower lever 93. A knife cam follower stud pin 97 is inserted through a stud aperture 99 in the knife cam follower lever 93, then through a first knife cam stud pin collar 101.

Figure 3:
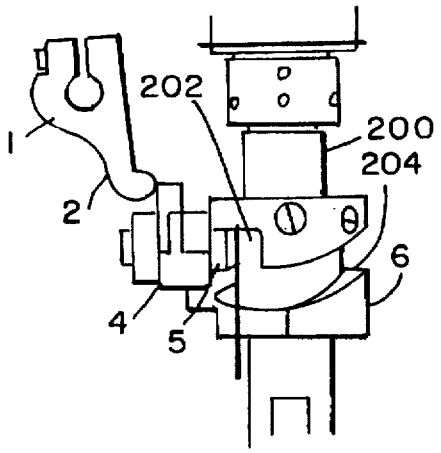
FIG. 3 is a top view of the engaging lever, knife follower lever, and follower pin and knife drive cam mounted on a needle bar drive shaft.

FIG. 3 shows a top view of the knife driving cam 6 with the follower lever 4 and follower pin 5 in initial engaged position. The engaging cam or arm 2 has moved the lever 4 into operative position, with a 0.5 mm clearance between an end of the follower pin and the cam. The knife cam 6 is mounted with two adjusting set screws 7 on the needle bar drive shaft 200.

The knife cam mechanism drives the knife through the workpiece material, and then part of the way out, to prevent the knife from sticking in the material. The knife cam may be rotationally adjusted using the two micro adjusting screws 7. Loosening the top screw and tightening the bottom screw moves the knife cam counterclockwise.

Figure 4:
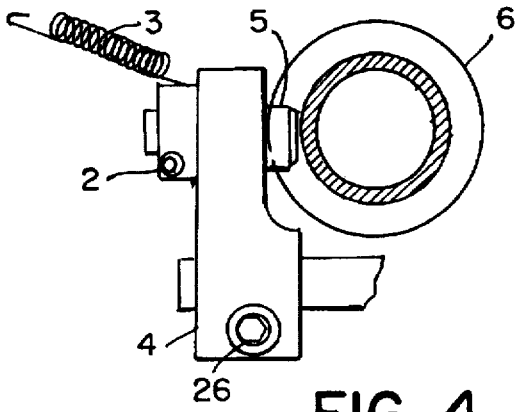
FIG. 4 is a side view of the engaged cam pin and collar, the follower lever, the knife drive shaft, and the cam in partial cross-section.

FIG. 4 is a side view of the pin 5 engaged with the knife drive cam 6. The clamping screw 26 is shown clamping the lever 4 to the knife drive shaft which is part of the knife lever assembly 8 shown in FIG. 1. The collar 2 is shown fixed to the pin by a screw. Return spring 3 pulls the lever 4 to the knife-up position. The wide opening 202 in the home or cam track 204 allows return spring 3 to pull the knife to the up position.

Figure 5:
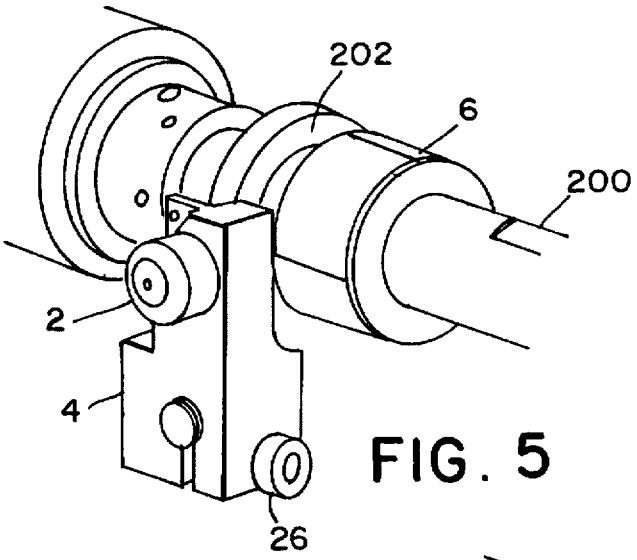
FIGS. 5 and 6 are perspective views of the engaged cam.
Figure 6:
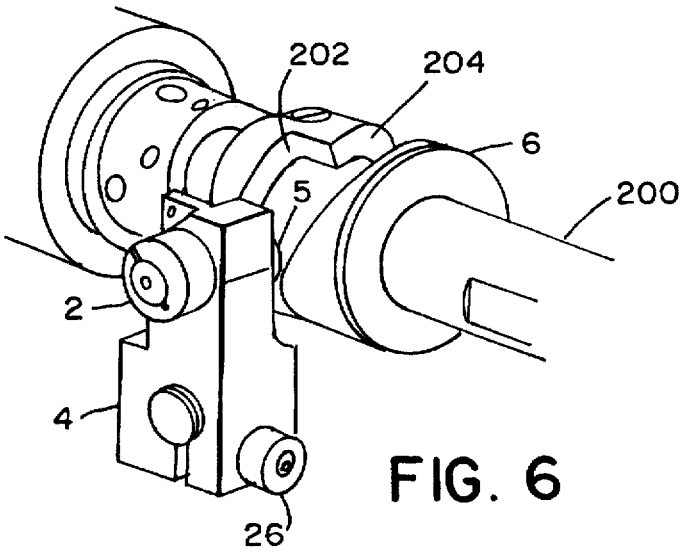

FIGS. 5 and 6 are perspective views of the engaged knife drive follower pin 5 and the knife drive cam 6 with the cam in different rotational positions.

Figure 7:
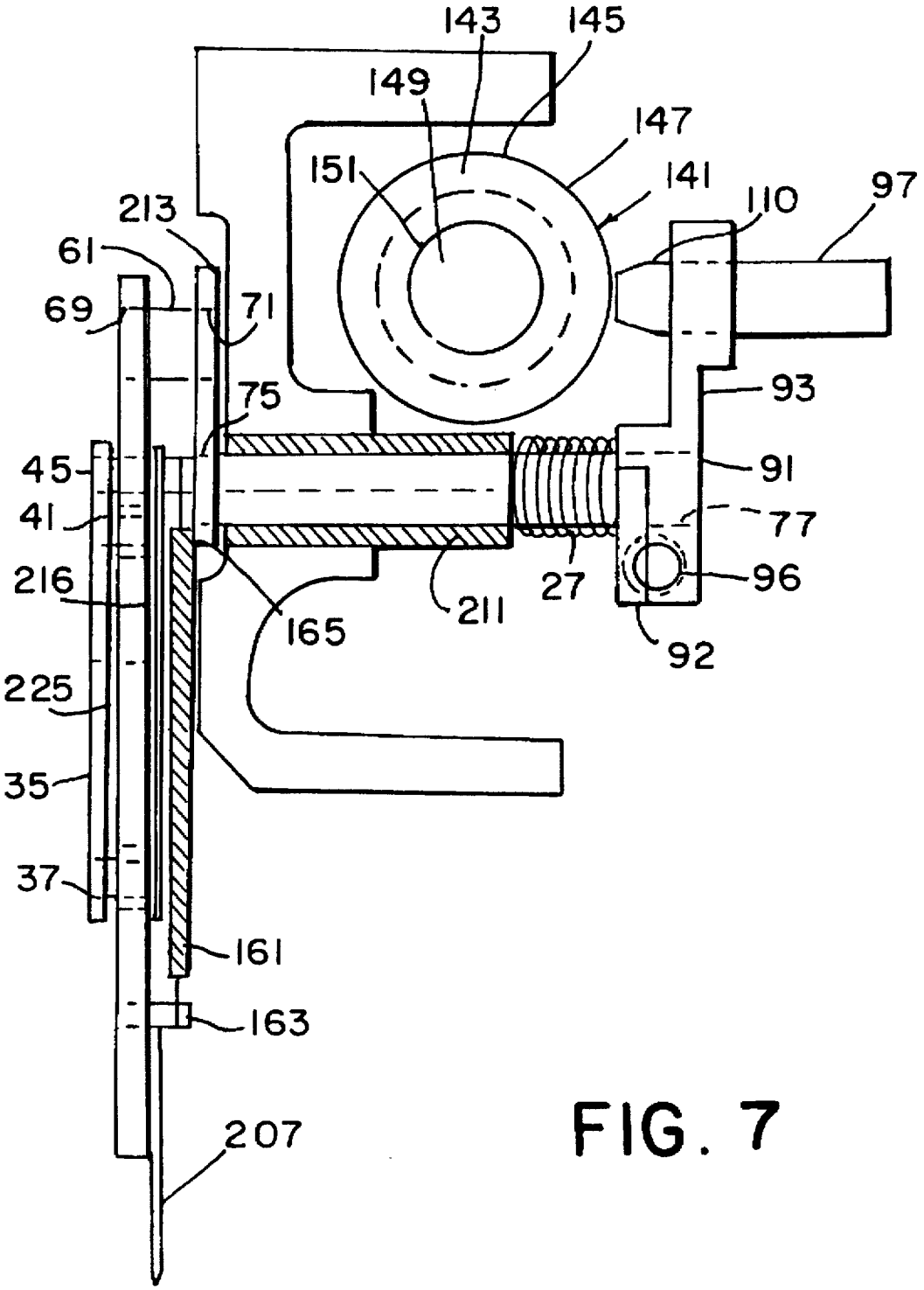
FIG. 7 is a side elevation of an assembled knife mechanism of FIG. 2.

FIG. 7 is a cross-sectional view of the knife mechanism. A knife drive cam is schematically shown as a grooved barrel cam 141 having a groove 143 on an outside surface 145 of the cam 141 that follows a circumference 147 of the cam 141 and snakes out axially parallel to a central axis 149 of the cam 141 and back. The cam 141 is mounted on a needle bar drive shaft 151, and a driver rotates the drive shaft 151 about a central axis 153 of the drive shaft 151. A knife cam follower stud pin 97 is shown in a disengaged position. The pin 97 is held in the knife cam follower lever 93 and is spaced from the grooved barrel cam 141. An end 77 of the knife shaft 211 is inserted into a shaft aperture 91 in the shaft end 100 of the knife cam follower lever 93. A clamping hole 96 is positioned in the shaft end 100 of the knife cam follower lever 93 perpendicular to and exterior to the shaft aperture 91 to secure the knife shaft 211 in the knife cam follower lever 93. A first end 75 of the knife shaft 211 is inserted into an aperture in the knife lever 213. A knife stud pin 61 is inserted into the first distal aperture 71 of the knife lever 213. The stud pin 61 connects the knife lever 213 to the knife holder 225. A cover plate 35 and a holder bracket 216 are positioned parallel to the knife holder 225. A spring 161 has a knife end 163 and an upper end 165. The upper end 165 is connected near the first end 75 of the knife shaft 211. The spring 161 is replaced by return spring 3 in the preferred embodiment. A knife 207 is connected to the lower end of the knife holder 225. Oscillation of the knife lever 213 causes the knife 207 to pierce a workpiece and create an opening in the workpiece to form a buttonhole and then return to its upper position. The compression spring 27 which surrounds the knife drive shaft 211 urges the cam follower lever 93 and the pin 97 out of engagement with the cam once the engaging arm releases the follower lever 93.

While the invention has been described with reference to specific embodiments, modifications and variations of the invention may be construed without departing from the scope of the invention, which is defined in the following claims.

We claim:

1. A knife apparatus for use in a buttonhole sewing machine for cutting a buttonhole comprising a grooved barrel cam for mounting on a needle bar drive shaft and rotating about a central axis of the needle bar drive shaft, the cam having a groove on an outside surface of the cam that follows a circumference of the cam and runs axially along the cam and back, a knife cam follower lever having a pin end and a shaft end, a knife cam follower stud pin mounted in the pin end for receiving in the groove of the cam, the knife cam follower lever being rotatable for allowing the knife cam follower stud pin to engage and follow the groove of the cam, a knife drive shaft having a first end and a second end, the second end being connected to the shaft end of the knife cam follower lever for pivoting the knife cam follower lever and the knife drive shaft about a central axis of the knife drive shaft, a knife lever having a knife end and a rotation end, the rotation end being connected to the first end of the knife drive shaft for pivoting the knife lever with the knife drive shaft about the central axis of the knife drive shaft, a knife holder connected to the knife end of the knife lever for moving down and up as the knife lever oscillates with the knife drive shaft, and a knife connected to the knife holder for piercing a workpiece and creating a buttonhole in the workpiece.

2. The apparatus in claim 1, wherein the knife cam follower stud pin has a cam end and a mounting end and wherein the knife cam follower lever further comprises a lever arm block at the shaft end of the knife cam follower lever and further comprising an engaging arm abutting the lever arm block for moving the knife cam follower lever toward the cam, the pin end of the knife cam follower lever having a stud aperture for receiving and securing the knife cam follower stud pin and the shaft end of the knife cam follower lever having a slotted shaft aperture for receiving the first end of the knife drive shaft and a clamping hole transverse to the shaft aperture to receive a clamping screw to secure the knife shaft into the shaft aperture.

3. The apparatus of claim 2, further comprising a cam follower lever moving spring having a first end and a second end, the first end abutting a back of a shaft hole in a machine housing and the second end abutting the shaft end of the knife cam follower lever, the lever moving spring surrounding the knife drive shaft whereby when the engaging arm no longer presses against the knife cam follower lever, the spring returns the knife cam follower lever to a rest position with the follower pin disengaged from the groove of the cam.

4. The apparatus of claim 1, the knife holder having an upper end, a middle section, a lower end, and a knife mounting section extending from the lower end wherein the knife holder has a first opening passing through the upper end, and a connector connected to the middle section for maintaining the knife holder vertical as the knife lever and knife drive shaft oscillate, a connecting aperture in the knife mounting section for connecting the knife to the knife mounting section connecting aperture using a screw, and the upper end being pivotally connected to the knife end of the knife lever.

5. The apparatus of claim 4, wherein the connector comprises a link pivoted at a first end to the middle section and pivoted at a second end to a housing, and a knife cover connected to the housing and overlaying the middle section of the knife holder.

6. The apparatus of claim 4, further comprising an upper knife roller, a lower knife roller, an upper pin, and a lower pin, wherein the upper and lower rollers receive the upper and lower pins and upper and lower elongated openings on the knife holder receive the upper and lower rollers respectively, and further comprising a holder bracket mounted to the machine housing having an upper hole that receives and connects to the upper pin, and a lower hole that receives and connects to the lower pin, whereby when the crank pivots, the knife holder moves upward and downward with the elongated openings moving the rollers.

7. The apparatus of claim 1, further comprising a knife return spring having a first end and a second end, wherein the first end is connected to cam follower lever and the second end of the knife return spring is connected to the housing, whereby when the knife holder moves downward to create a hole, the knife return spring is extended and facilitates the return of the holder to an original position after the hole has been formed.

8. The apparatus of claim 4, the knife lever having a cylindrical knife stud pin having a first recessed end which is received by and connected to an aperture of the knife lever and having a second end which is received by and connected to the first opening passing through the upper end of the knife holder and wherein the first end of the knife shaft connects to the aperture of the knife lever such that when the knife shaft oscillates, the knife lever and the knife stud pin oscillate and the knife holder is moved down and up.

9. The apparatus of claim 1, further comprising a sewing machine having a housing, a needle bar drive shaft mounted near a top of the housing, an opening passing through the housing transverse to the needle bar drive shaft and beneath the needle bar drive shaft, wherein the knife drive shaft passes through the opening in the housing.

10. A method of cutting a buttonhole with a buttonhole sewing machine comprising the steps of moving an engaging arm, pushing a lever arm against a knife cam follower lever which has a pin end and a shaft end, and moving the follower pin into engagement with a groove in a surface of a barrel cam, rotating the cam and the groove, following the groove with the follower pin, oscillating the knife cam follower lever with the pin, oscillating a knife drive shaft with the knife cam follower lever causing the knife drive shaft to pivot, passing the knife drive shaft through a shaft hole from an inside of the machine housing to an outside of the machine housing, oscillating a knife lever with the knife drive shaft, moving a knife downward towards a workpiece, piercing the workpiece with the knife, and cutting a buttonhole opening in the workpiece.

11. The method of claim 10, further comprising the steps of translating a knife stud pin with the knife lever, pivoting the shaft, causing the knife lever to pivot with the shaft, moving a knife holder downward and upward with the knife stud pin, guiding a middle section of the knife holder, maintaining the knife holder vertical, and moving the knife downward and upward with the knife holder.

12. The method of claim 11, further comprising the steps of compressing a release spring when the engaging arm pushes the knife cam follower lever, abutting an inside of a shaft hole in the machine housing, and abutting a shaft end of the knife cam follower lever with the release spring, releasing the knife cam follower lever with the engaging arm after the knife has cut the buttonhole, and moving the knife cam follower lever back to a rest position with the release spring.

13. The method of claim 10, further comprising the steps of extending a knife return spring when the knife cam follower lever moves from an original angular position, contracting the knife return spring, and returning the knife cam follower lever to the original angular position with the return spring after releasing the lever arm.

14. The method of claim 13, further comprising the step of returning the knife drive shaft, the knife lever, the knife holder and the knife to an original position as the return spring moves the cam follower lever to the original angular position.

* * * * *